US006105401A

United States Patent [19]

Chadeyron et al.

[11] Patent Number: 6,105,401

[45] Date of Patent: Aug. 22, 2000

[54] KNITTED TEXTILE STRUCTURE WITH DOUBLE SKIN AND ADJUSTABLE BINDING THREADS AND METHOD OF MANUFACTURE

[75] Inventors: Patrick Chadeyron, Arcachon; Félix Schiano, Leogn'An; Eric Schiano, Cestas, all of France

[73] Assignee: Commissariat a l'Energie Atomique, France

[21] Appl. No.: 09/194,982

[22] PCT Filed: Jun. 3, 1997

[86] PCT No.: PCT/FR97/00964

§ 371 Date: Dec. 4, 1998

§ 102(e) Date: Dec. 4, 1998

[87] PCT Pub. No.: WO97/46749

PCT Pub. Date: Dec. 11, 1997

[30] Foreign Application Priority Data

Jun. 4, 1996 [FR] France ..... 96 06879

[51] Int. Cl.[7] ..... D04B 21/00

[52] U.S. Cl. ..... 66/195; 66/196; 66/202

[58] Field of Search ..... 66/202, 196, 195, 66/88, 87, 192, 194, 203; 2/16, 22; 442/318, 315, 313, 314

[56] References Cited

U.S. PATENT DOCUMENTS

| | | | |
|---|---|---|---|
| 4,601,940 | 7/1986 | Fischer | 66/195 |
| 4,785,558 | 11/1988 | Shiomura | 66/195 |
| 4,787,219 | 11/1988 | Sato et al. | 66/195 |
| 5,077,837 | 1/1992 | Meistrell | 2/16 |
| 5,385,036 | 1/1995 | Spillane et al. | 66/87 |

FOREIGN PATENT DOCUMENTS

| | | | |
|---|---|---|---|
| 0339227 | 11/1989 | European Pat. Off. | D04B 1/00 |
| 0449033 | 10/1991 | European Pat. Off. | B29C 67/14 |
| 0610845 | 8/1994 | European Pat. Off. | D04B 1/00 |
| 0630997 | 12/1994 | European Pat. Off. | D04B 21/00 |
| 9213125 | 8/1992 | WIPO | D04B 1/14 |

*Primary Examiner*—Danny Worrell

*Attorney, Agent, or Firm*—Hayes, Soloway, Hennessey, Grossman & Hage, P.C.

[57] ABSTRACT

A textile structure with dual layers is knitted in a single operation such that linking threads forming the core of the structure have an orientation that can be adapted to requirements, in both the warp and weft directions. To achieve this, each course of linking threads is engaged alternatively on each layer with selected stitches on a single course of stitches. In addition, two consecutive courses of linking threads are engaged on one of the layers with a single course of stitches and, on the other layer with non-consecutive courses of stitches.

24 Claims, 12 Drawing Sheets

KNITTED TEXTILE STRUCTURE WITH DOUBLE SKIN AND ADJUSTABLE BINDING THREADS AND METHOD OF MANUFACTURE

FIELD OF THE INVENTION

The present invention mainly relates to a textile structure formed in a single operation by means of one or more knitted threads and comprising two skins or layers each of which consists of rows or courses of stitches linking the two layers and a core composed of linking threads connecting the two layers.

The invention also relates to a method for manufacturing the said textile structure.

The knitted textile structure of the invention can be used in many industrial sectors.

Purely as an example, when the knitted thread or threads composing the textile structure are dry or non-impregnated various applications are possible, particularly in the field of heat insulation for uses such as clothing, flexible fireproof barrier, etc. and in the field of anti-shrapnel protective clothing. Moreover, when the knitted thread or threads composing the textile structure are impregnated with an organic matrix to produce a composite material suitable for use at low temperatures (below 400° C.) the said composite material may be used to construct sandwich panels of any format capable of being curved along one or more axes. In particular, this type of panel may be used to carry a fluid such as coolant. They may also be used for producing an inflatable structure or anti-ballistic shielding structure. Filling the core of the structure with a suitable material also makes it possible to construct particularly efficient thermal protection structures.

Lastly, when the knitted thread or threads are impregnated with a ceramic or carbon matrix to give the textile structure the characteristics of a refractory composite material, the material may particularly be used to construct support structures for carbon—carbon composite optical structures for use in the aerospace industry or to construct refractory radomes for high-resolution radar systems.

BACKGROUND ART

For many years sandwich structures have been produced comprising honeycomb or foam cores both surfaces of which are covered by a panel composed of several layers of fabric impregnated with polymerized resin.

These sandwich structures are extremely light while having good mechanical resistance to compression and flexion. However, the fact that they are constructed by combining three separate components limits their cohesion and it is not possible to adapt the mechanical properties of the structure to precise specifications. Furthermore, traditional sandwich structures have to be planar.

There have also been proposals for a textile structure comprising a core covered by two layers produced in a single operation. More precisely, proposals have been made to produce a composite sandwich structure composed of a velvet construction consisting of two foundation warps and one pile warp before the latter is cut to obtain two separate pieces of fabric.

Although this type of textile structure has the advantage of being easily produced in a single operation and of giving greater cohesion than a standard sandwich structure, the construction of non-planar panels remains virtually impossible in practice due to the use of a weaving method that requires the warp and weft threads to be kept taut. This phenomenon is exaggerated by the simultaneous construction of two textile surfaces and a network of threads connecting the said surfaces.

Moreover, in a textile structure produced using this method it is very difficult to control the orientation of the linking threads constituting the core of the structure and thus to adapt the mechanical properties of the structure to precise specifications.

Document number WO-A-92 13125 also proposes to construct thermal insulation panels using a textile armature constructed in a single knitting operation and comprising two knitted layers linked to one another by a network of linking threads.

Compared with a woven textile structure, this type of knitted textile structure has the advantage of being capable of being shaped, making it possible to produce non-planar panels with single or multiple curvature. The knitting technique causes formation of stitches that give a certain degree of flexibility to the layers of the textile structure.

However, the structure described in document number WO-A-92 13125 is produced using a cycle that consists in knitting one course of stitches on each layer and linking them together with a course of linking threads on a double-bed machine. This results in the linking threads being oriented virtually at a right angle to the two textile surfaces forming the layers of the structure in the direction of its warp. The textile structure described in this document is therefore incapable of adapting its mechanical properties to precise specifications by giving total control over the orientation of the linking threads.

In US document No. U.S. Pat. No. 5,385,036 a textile structure is knitted using a Raschel-type knitting machine with two needle-bars. All the needles are constructed as part of the bar and make the same movements simultaneously.

The textile structure produced by this type of machine comprises two layers connected by linking threads. However, one of the networks of linking threads has to be perpendicular to the planes of the layers. Moreover, in the structure described most of the linking threads are attached in alternating course to one of the layers.

DISCLOSURE OF THE INVENTION

The main object of the invention is a knitted textile structure whose special design makes it possible to orient the linking threads at will and consequently to adapt the mechanical properties of the structure to precise specifications while retaining the shaping possibilities conferred by the use of a knitting technique.

According to the invention this result is obtained by means of a textile structure formed by at least one knitted thread and comprising two layers each of which is composed of courses of stitches, and a core composed of two courses of linking threads connecting the two layers, each course of linking threads is attached on one or the other of the layers alternately to a different stitch of a single course of stitches to form a first non-zero angle between consecutive linking threads of the same course of linking threads, characterized by the fact that two consecutive courses of linking threads are attached to a single course of stitches of one of the layers and to non-consecutive courses of stitches of the other layer to form a second, non-zero angle between consecutive courses of linking threads, the first angle and the second angle being measured in planes that both form angles other than 90° with the planes of the layers.

In a textile structure produced as described above the first angle formed between the linking threads of the same course, working in one direction of the weave of the structure, and the second angle formed between the linking threads of different courses, working in one warp direction of the structure, can be controlled virtually at will. For example, the first angle may be modified by changing the spacing between the needles of the knitting machine and/or by engaging linking threads to stitches, consecutive or otherwise. The second angle is dependent on the number of courses of stitches knitted on each layer of the textile structure between two consecutive courses of linking threads.

Two types of textiles structures according to the invention can be produced depending on whether the courses of linking threads are engaged with the courses of stitches without actually forming stitches, i.e. without the needles of the machine knitting the linking thread, or the courses of linking threads being engaged with the courses of stitches thereby themselves forming stitches, i.e. knitting the linking thread. In this second type of textile structure according to the invention the linking thread is knitted to each layer and each layer is incremented with each course of linking threads.

Another distinction between the different textiles of the invention may be made by observing, working in one warp direction of the textile structure, with which stitches of a course the linking threads are engaged.

For example, the linking threads comprising the core of the textile structure have a pyramid configuration when the stitches with which the courses of linking threads are engaged are aligned with the warp of the structure.

The linking threads may also form an X configuration when the textile structure is observed looking along the direction of the warp. This result is obtained by engaging consecutive courses of linking threads with stitches offset in one direction of the warp of the textile structure and by engaging alternate courses of linking threads to stitches aligned with the direction of the warp.

As was pointed out above, the first angle may be modified to comply with specifications by selecting the stitches with which each course of linking threads is engaged.

For example, a relatively slight first angle is obtained by engaging courses of linking threads from alternate layers to all the consecutive stitches of the same course of stitches.

A greater first angle may be obtained by engaging courses of linking threads from alternate layers to non-consecutive stitches of the same course of stitches. These non-consecutive stitches may then be separated by a constant number of stitches (this number being at least 1) or by a number of stitches that varies between two different values to give a regular pattern. In this latter configuration the linking threads have different angles relative to the layers while in the former they may or may not be identical as required.

The angle of the linking threads also depends on the relative position of the stitches to the two layers.

For example, the stitches of the two layers may be disposed facing one another or offset so that each stitch of one layer is located between two stitches in the other layer working in the direction of the weft of the structure.

The textile structure of the invention may be used in the dry state, i.e. without impregnating the thread or threads composing it. However, certain applications require the presence of an impregnation matrix and shaping of the knitted thread. In this configuration the core of the structure forms an open space between the linking threads.

In other applications the open space formed between the linking threads contains a filler matrix which may be constructed out of the same material as the impregnation matrix or some other material.

The invention also relates to a method for manufacturing the type of textile structure described above.

More precisely, the invention relates to a manufacturing process for a textile structure made from at least one knitted thread and comprising two layers each composed of course of stitches and a core composed of courses of linking threads connecting the two skins characterized by the fact that it consists in repeating the following cycle:

- constructing a first course of linking threads by engaging knitted thread alternately on different needles of first and second courses of facing needles;
- constructing at least one course of stitches on the first course of needles;
- constructing a second course of linking threads by engaging knitted thread with the first and second course of needles alternately;
- constructing at least one course of stitches on the second course of needles.

As required, the different courses of linking threads may be formed either by engaging the knitted thread with the needles without forming stitches, or by engaging the knitted thread with the needles so as to form stitches.

Different textile structures are obtained depending on whether the first and second courses of linking threads are formed by engaging the knitted thread with the same needles of the first and second courses of needles, or by forming them by engaging the knitted thread with different needles of at least the first and second courses of needles.

Different textile structures are also obtained by forming the first and second courses of linking threads by engaging knitted thread either with all the consecutive needles of the first and second courses of needles or with non-consecutive needles of the same courses. In the first configuration the two courses of needles are preferably offset from one another in the direction of the weft of the structure being produced. In the second configuration the non-consecutive needles with which the knitted thread is engaged may be separated by a constant number of threads or by a number of needles that varies between two given values to form a regular pattern. Moreover, the needles of the two courses of needles may either be offset from one another relative to a weft direction of the structure or positioned facing one another.

When the textile structure is not used dry it is next shaped by placing it on a shaping surface and impregnating the knitted thread with an impregnation material. This is done while keeping the two layers of the structure apart from one another. The impregnation material is then hardened so that the core of the structure forms an open space free of impregnation material between the linking threads.

In certain applications a filler material is introduced into the open space.

BRIEF DESCRIPTION OF THE DRAWINGS

Several versions of the invention will now be described. These examples are non-limitative and refer to the attached drawings wherein.

DISCLOSURE OF PREFERRED EMBODIMENTS OF THE INVENTION

Figure 1:
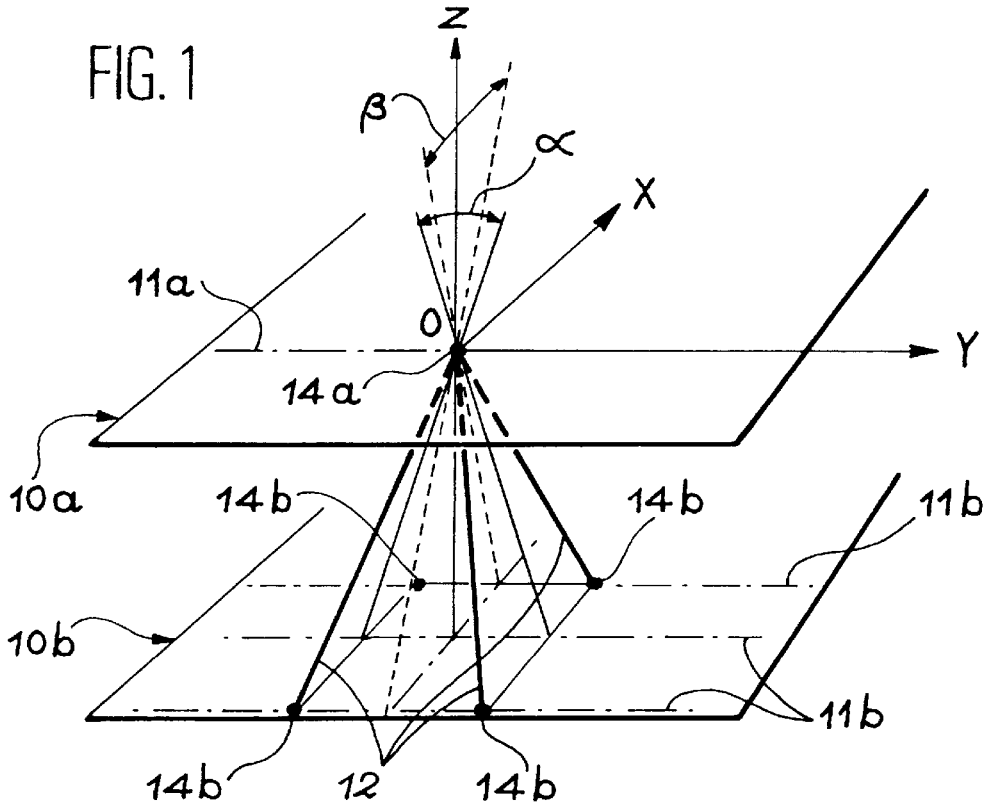
FIG. 1 is a perspective view showing a very schematic representation of one of the basic cells constituting a textile structure according to a first version of the invention.
Figure 2:
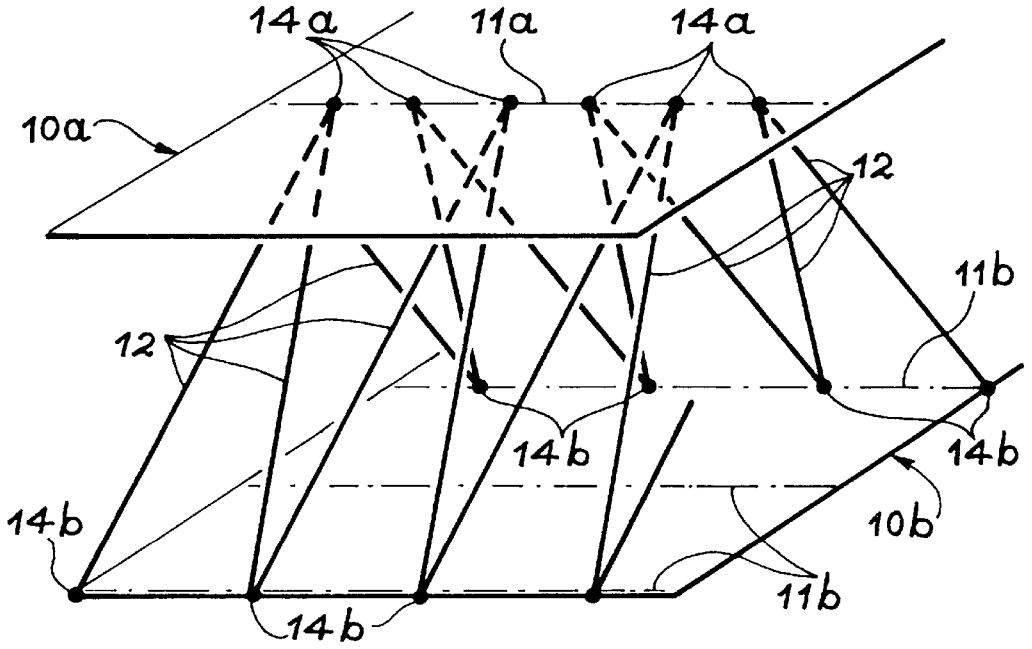
FIG. 2 is a perspective view similar to FIG. 1, showing a schematic representation of a second version of the textile structure according to the invention.

As was illustrated very schematically in FIGS. 1 and 2, the textile structure of the invention comprises two layers 10*a* and 10*b* joined by a core consisting mainly of linking threads 12.

More precisely, this textile structure is obtained in a single operation by knitting one or more threads on a suitable knitting machine. Different techniques for manufacturing this structure are described below. Each of layers 10*a* and 10*b* of the textile structure consists of courses of knitted stitches that are oriented in the direction of the weft of the structure (shown as axis OY in FIG. 1). Each course of stitches is shown by a dotted line and numbered 11*a* or 11*b* depending on whether it is part of layer 10*a* or 10*b*.

In FIG. 1 the direction of the warp of the structure is shown as axis OX whereas axis OZ is oriented in the direction of the thickness of the structure.

According to the invention linking threads 12 are disposed in courses of linking threads oriented in the direction of weft OY of the structure. Each of these courses of linking threads is alternately engaged with each of layers 10*a* and 10*b* by a different stitch 14*a*, 14*b* of a single course of stitches 11*a*, 11*b* to form a first non-zero angle α (FIG. 1) between consecutive linking threads 12 of a single course of linking threads. Moreover, two consecutive courses of linking threads 12 are engaged with a single course of stitches 11*a*, 11*b* of one of the layers 10*a*, 10*b* and with two non-consecutive courses of stitches of the other layer to form a second non-zero angle β between consecutive courses of linking threads 12.

It should be noted that angles α and β are measured in the planes containing linking threads 12 and that these planes may form any angle (i.e. different from 90°) with the planes of layers 10*a* and 10*b*.

In the version shown in FIG. 1 four linking threads 12 from two consecutive courses of linking threads of the structure are engaged with a single stitch of one of the layers (for example, stitch 14*a* of layer 10*a* in FIG. 1) and to four stitches from two non-consecutive courses of courses of stitches of the other layer (for example, four stitches 14*b* of layer 10*b* in FIG. 1) to form a square or rectangle. Each group of four adjacent linking threads 12 thus forms a pyramid-shaped component stitch.

In the version shown in FIG. 2 two consecutive courses of linking threads 12 are engaged alternately with different stitches of a single course of stitches of one of the layers (for example, stitches 14*a* of layer 10*a* in FIG. 2). These two courses of linking threads 12 are engaged with stitches on non-consecutive courses of stitches of the second layer (for example, stitches 14*b* of layer 10*b* in FIG. 2), forming isosceles triangles on the layer.

In other words, if it is considered that the space between the hooking stitches of one course of linking threads 12 of each layer 10*a* and 10*b* of the structure constitutes the weft pitch of the linking threads on the layer in question, two consecutive courses of linking threads are offset from one another by half a unit working in the weft direction of the structure.

This description of the two versions illustrated as examples in FIGS. 1 and 2 shows that the textile structure of the invention makes it possible to give the linking threads 12 any orientation and relative disposition required to meet any specifications demanded by a specific application.

To complete this explanation of the versatile character of the textile structure of the invention reference will now be made to FIGS. 3 to 6 successively.

Figure 3:
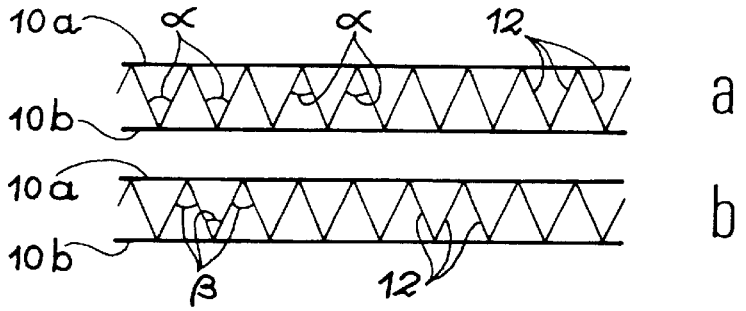
FIG. 3 is a schematic view showing respectively at a and b sections in the direction of the weft and the direction of the warp through the textile structure of FIG. 1.

FIG. 3 shows respectively at a and b sections in the direction of the weft and the direction of the warp of a textile structure of which the component stitch is comparable to that described above with reference to FIG. 1. In this configuration it will be seen that angles α and β of linking threads 12 working respectively in the direction of the weft and the warp of the textile structure are more or less identical. It will also be seen that the bisectors of angles α and β are perpendicular to layers 10*a* and 10*b* of the structure.

When the textile structure of FIGS. 1 and 3 is observed along the direction of the warp it will be seen that all the linking threads 12 are aligned in this direction. This means that all the linking threads 12 of all the layer of linking threads of layers 10*a* and 10*b* are engaged with stitches 14*a* and 14*b* that are also aligned in the direction of the warp of the textile structure.

Figure 4:
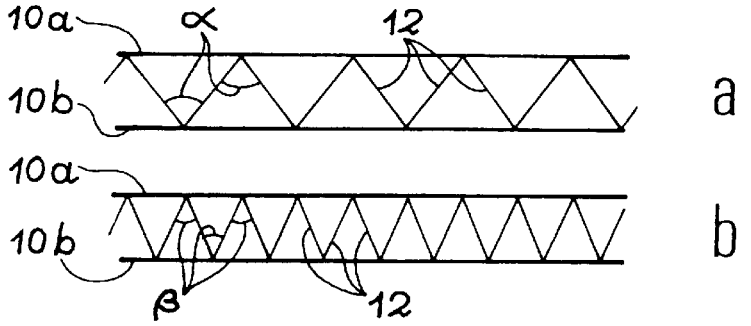
FIG. 4 is a schematic view similar to that of FIG. 3 showing respectively at a and b sections in the direction of the weft and the direction of the warp through a textile-structure in which the first angle is greater than that of FIG. 3.

FIG. 4 shows respectively at a and b sections similar to those of FIG. 3 of a textile structure whose component stitch is of the same type as that shown in perspective in FIG. 1. However, this structure differs from that of FIG. 3 in that the value of angle α is significantly greater while that of angle β is virtually unchanged. A detailed explanation of how modifications to angle α can be obtained is given below.

Figure 5:
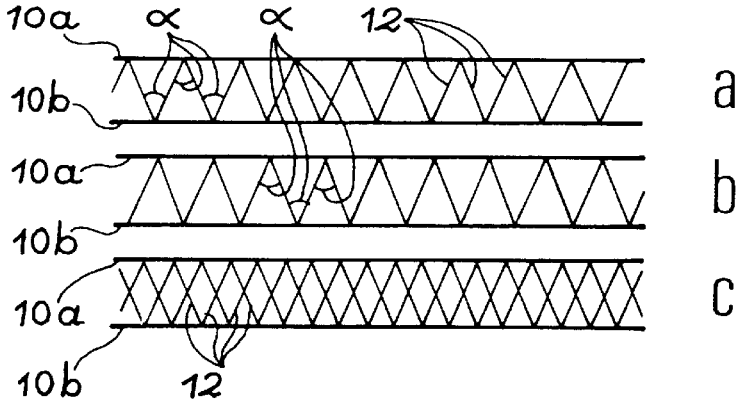
FIG. 5 is a schematic view in which a is a section in the direction of the weft through a given course of linking threads of the textile structure of FIG. 2, b is a section in the same direction through an adjacent course of linking threads to a, and in which c shows sections a and b superimposed.

FIG. 5 shows a structure comparable to that shown in perspective in FIG. 2. a and b of this figure show two sections of the structure working in the direction of the weft and passing through two consecutive courses of linking threads 12. It will be seen from these two sections that the engagement of these two consecutive courses of linking threads 12 with stitches of layers 10*a* and 10*b* is effected for each layer at stitches that are offset from one another by half a unit working in the weft direction of the structure. In contrast, in each of the two groups of courses of linking threads 12 comprising every other course of linking threads, the linking threads 12 are aligned in the direction of the warp of the structure. The same is true of the stitches of each of layers 10*a* and 10*b* with which these linking threads are engaged.

Thus superimposing two consecutive courses of linking threads 12, as shown at c of FIG. 5, gives the core of the textile structure an X-shaped configuration when observed in the direction of the warp.

In this version of FIG. 5 the bisectors of angles α are perpendicular to layers 10*a* and 10*b* of the structure as in the versions shown in FIGS. 3 and 4. In other words the angle formed between each of the linking threads 12 and the layers 10*a* and 10*b* in the direction of the weft of the structure is the same for all the linking threads 12.

Figure 6:
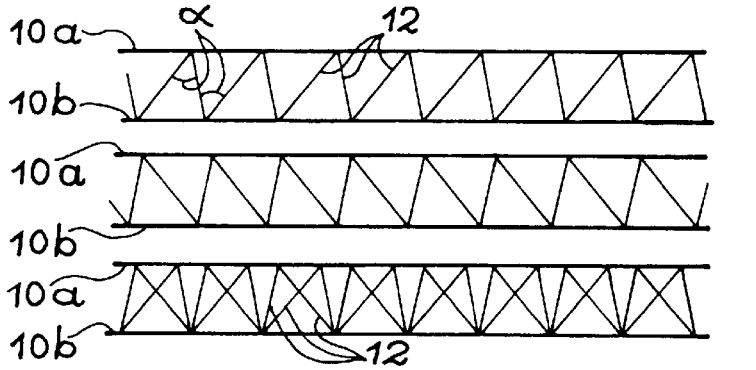
FIG. 6 is a schematic view similar to that of FIG. 6 and shows respectively at a and b sections of a textile structure that is slightly different from that of FIG. 5. The section is through two consecutive courses of linking threads in the direction of the weft of the structure, and in which c shows sections a and b superimposed.

The version shown in FIG. 6 is different from previous versions by virtue of the fact that the bisectors of angles α formed by linking threads 12 are not perpendicular to layers 10*a* and 10*b* of the structure. Moreover, the structure shown in FIG. 6 constitutes a variant on that described with reference to FIG. 5. For example, a, b and c of FIG. 6 represent sections comparable to those illustrated at a, b and c of FIG. 5.

More precisely, in this version of FIG. 6, consecutive linking threads 12 of the same course of linking threads have two different angles of incidence with layers 10*a* and 10*b*. As shown at c of FIG. 6, superimposing sections a and b that are two consecutive courses of linking threads gives the core of the textile structure a relatively complex geometry when observed in the direction of the warp. It is therefore possible to produce textile structure to meet any specifications irrespective of the intended application.

Figure 7:
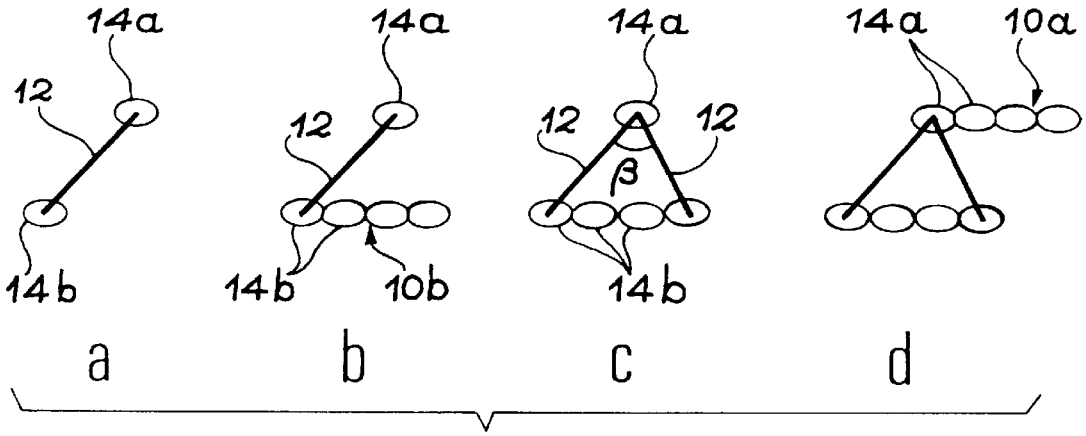
FIG. 7 is a schematic view that shows respectively at a, b, c, and d the four main stages in the production cycle of the textile structure of the invention.

FIG. 7 is a very schematic illustration of a production cycle of the invention. More precisely, a, b, c, and d of FIG. 7 are the four main stages in the production cycle. The cycle must be repeated many times in order to produce a complete textile structure.

As shown at a in FIG. 7, the first stage of the cycle consists in producing a course of linking threads 12 engaging the said linking threads with stitches 14*a* located in a single course of stitches of layer 10*a* and with stitches 14*b* of a single course of stitches of layer 10*b*.

The second stage of the cycle, shown schematically at b of FIG. 7, consists in constructing one or more courses of stitches in a single layer of the structure. In the example given at b several courses of stitches 14*b* are made in layer 10*b*.

The third stage in the cycle, illustrated schematically at c of FIG. 7, consists in constructing a new course of linking threads 12. This course of linking threads 12 is engaged alternately with stitches from the last two courses of stitches made in skins 10*a* and 10*b*. In the example shown, this new course of linking threads 12 is engaged with layer 10*a* at the course of stitches 14*a* with which the previous course of linking threads 12 is engaged, with layer 10*b* at the last course of stitches 14*b* made during the previous stage illustrated at b.

The fourth stage of the cycle, illustrated at d of FIG. 7, consists in constructing one or more courses of linking threads on the other layer. In the example shown one or more courses of stitches 14*a* are made on layer 10*a*.

As has already been explained, the cycle must be repeated the number of times needed to produce the length of textile structure required.

The above description with reference to FIG. 7 shows that angle β formed between the linking threads 12 in the direction of the warp of the textile structure is mainly dependent on the number of courses of stitches 14*a* and 14*b* between the construction of two consecutive courses of linking threads 12. Angle β may also be modified at will to meet specifications.

In order to give a better understanding of how the textile structure of the invention is constructed in practice a description will now be given of a knitting machine capable of being used to produce this type of structure. The description refers to FIGS. 8 to 10.

Given that the knitting machine used to produce the textile structure of the invention already exists, only a brief description of the components essential for understanding its operation will be given. If more detail is required reference can be made to the technical descriptions of existing machines.

Figure 8:
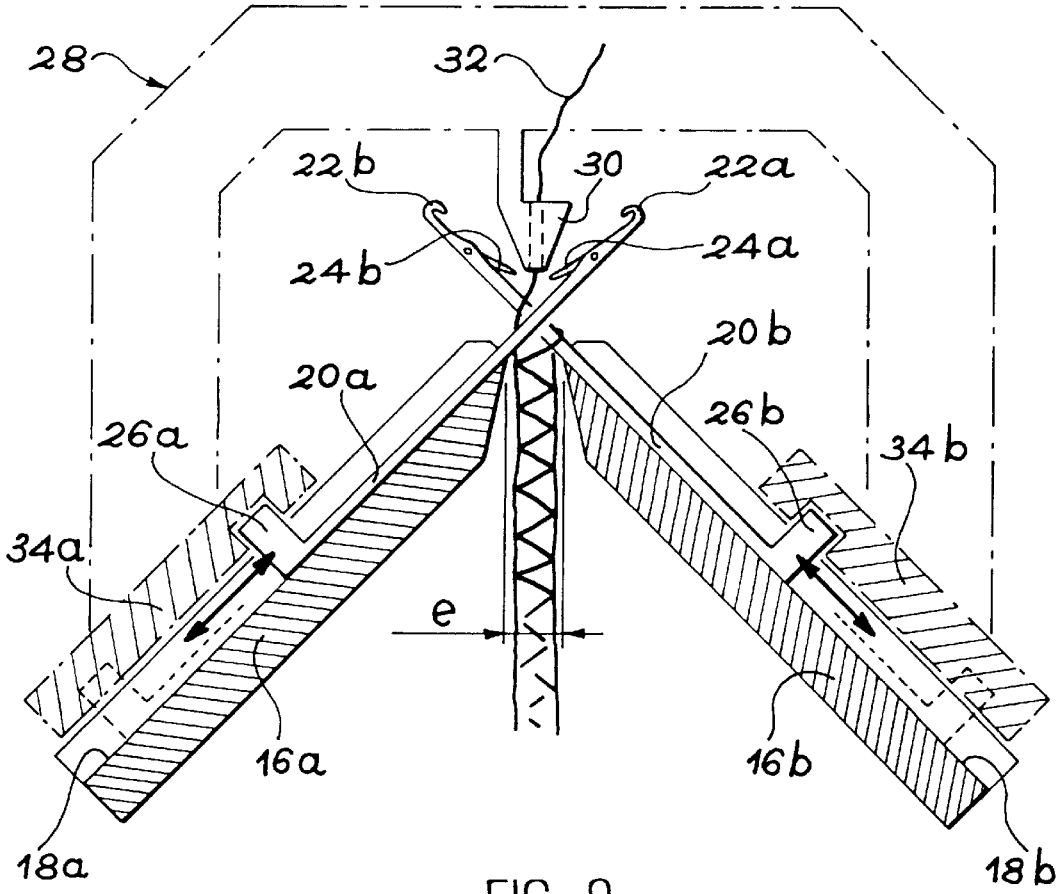
FIG. 8 is a view of a transverse section showing a very schematic representation of the active section of a knitting machine used to construct the textile structure of the invention.

The knitting machine used here is a rectilinear machine on which the needles and threads can be selected. It should be noted that a circular machine can also be used without going beyond the scope of the invention. As FIG. 8 shows very schematically, the machine comprises two needle support guides or knitting sections 16*a* and 16*b*. The two knitting heads 16*a* and 16*b* are inclined and disposed symmetrically relative to a vertical plane in which the textile structure is manufactured. More precisely, knitting heads 16*a* and 16*b* are disposed so that their nearest upper ends are separated by an adjustable gap e which determines the thickness of the textile structure produced. For example, the machine used during tests carried out by the applicant had a gap e that could be varied between 4.5 mm and 8 mm.

The respective upper surfaces of knitting heads 16*a* and 16*b* are provided with regularly spaced straight grooves 18*a* and 18*b*. These grooves are located in planes perpendicular to the vertical plane of symmetry of the knitting heads. It should be noted that the relative positions of knitting heads 16*a* and 16*b* can also be adjusted in the direction of the weft, i.e. perpendicular to the plane of FIG. 8. This type of setting makes it possible to bring the respective grooves 18*a* and 18*b* of the two knitting heads either into a position of alignment in which the grooves are facing one another or into an offset position in which the grooves of one of the knitting heads are located midway between the grooves of the other knitting head.

Each of the grooves 18*a* and 18*b* formed in knitting heads 16*a* and 16*b* receives a needle, respectively 20*a* and 20*b*. More precisely, each needle 20*a* and 20*b* is housed in one of grooves 18*a* and 18*b* so that it can slide in the groove.

The ends of needles 20*a* and 20*b* that project beyond the upper ends of knitting heads 16*a* and 16*b* are all identical. They are characterized by the fact that they each have a hook 22*a*, 22*b* that opens upwards and a latch 24*a*, 24*b*. Each latch 24*a* and 24*b* is hinged on its needle near the hook 22*a* and 22*b* so that it is either in the open position, i.e. pointing towards the bottom of the needle as shown in FIG. 8, or in the closed position, i.e. pointing towards the top of the needle and closing the hook 22*a*, 22*b*.

The other end of each needle 20*a* and 20*b*, i.e. the end opposite the hook 24*a*, 24*b*, is also fitted with a shank 26*a* and 26*b* respectively. This shank points upwards so that it projects out of the upper surface of the knitting head 16*a* and 16*b*. This arrangement makes it possible to control the movements of the needles 20*a* and 20*b* in grooves 18*a* and 18*b* required for knitting.

As shown very schematically in FIG. 8, the knitting machine also comprises a carriage 28 which straddles knitting heads 16*a* and 16*b*. Carriage 28 moves back and forth in a direction perpendicular to the plane of FIG. 8, i.e. in the direction of the weft of the textile structure.

The section of the carriage 28 located in the vertical plane of symmetry of the knitting heads 16*a* and 16*b* is fitted with a thread guide 30 positioned immediately above the line along which needles 20*a* and 20*b* can intersect as shown in FIG. 8. The knitting thread 32 used to manufacture the textile structure passes between the structure being produced and the reel of thread (not shown) via this thread guide 30.

It should be noted that if several threads are used, which is particularly the case when different threads are used to construct the layers and the linking threads of the textile structure, each of the threads passes through a different thread guide 30 borne by the carriage 28.

The main function of carriage 28 is to control the movement of needles 20*a* and 20*b* in their grooves 18*a* and 18*b* when it passes over the needles as it moves back and forth. It does this by means of a system of cams 34*a* and 34*b* located above each of the knitting heads 16*a* and 16*b*.

For the implementation of the invention and according to a known characteristic of existing machines each of the cam systems 34*a* and 34*b* comprises several cams capable of adopting an active or inactive position. Each time the carriage 28 completes a back-and-forth cycle a selecting mechanism (not shown) acts on each of the cam systems 34*a* and 34*b* to activate one of the cams of each system depending on the type of operation to be performed the next time the carriage 28 passes. This selection is automatic and pre-programmed.

In order to give a better understanding of the different manufacturing sequences of the textile structures of the invention that will be described below, an explanation will now be given, with reference successively to FIGS. 9 and 10, of the action of two types of cam of one of the cam systems on needles borne by the corresponding shank. More precisely, the description relates to two cams of cam system 34*a* acting on needles 20*a*. Clearly the cam system 34*b* is fitted with similar cams capable of acting on needles 20*b*.

Figure 9:
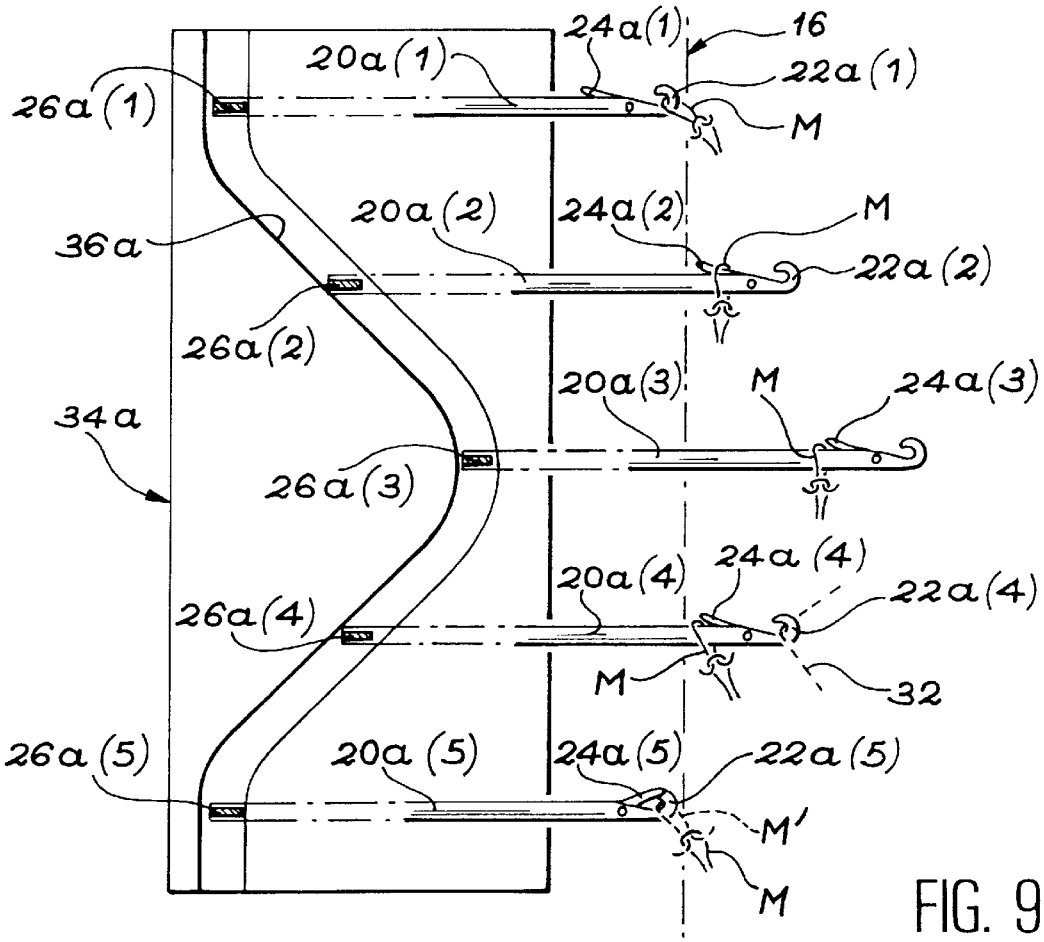
FIG. 9 is a top view showing a schematic representation of how a stitch is formed on one of the courses of needles as the carriage of the machine passes.

FIG. 9 shows a first cam 36*a* of cam system 34*a*. This first cam 36*a* is a groove into which tappets 26*a* of needles 20*a* fit when the carriage 28 is positioned facing them. Cam 36*a* is designed to produce a course of stitches on the textile structure.

In FIG. 9 the carriage is moving upwards such that the action of cam 36*a* on the needles 20*a* works from top to bottom. In order to make FIG. 9 easier to understand, the needles 20*a* are numbered 20*a*(1) to 20*a*(5) from top to bottom.

Needle 20*a*(1) is in the waiting position, i.e. its shank 26*a*(1) has penetrated cam 36*a* but the cam has yet to cause the needle 20*a*(1) to move. The needle is therefore in the low position in its groove 18*a* and its hook 22*a*(1) is virtually retracted in the knitting head 16*a*. Hook 22*a*(1) carries a stitch M made during a previous pass of the carriage. The latch 24*a*(1) is open.

Needle 20*a*(2) has started moving upwards in its groove 18*a* due to the action of cam 36*a* on its shank 26*a*(2). Due to the angle of incidence of the needles 20*a* shown in FIG. 8 and the traction stress usually exerted on the textile structure during manufacture, stitch M has moved free of the hook 22*a*(2) and is positioned on the latch 24*a*(2) but has not yet passed over the end of the latch.

Needle 20*a*(3) is subject to the maximum activity caused by the cam 36*a*. It is in the extreme high position in groove 18*a* characterized by the fact that stitch M has passed over the end of the latch 24*a*(3) and is resting directly on the body of the needle.

Needle 20*a*(4) has started to move back down groove 18*a* due to the action of cam 36*a* and lies in a position similar to that of needle 20*a*(2). The previous stitch M still lies beyond the end of latch 24*a*. The essential difference from the situation on needle 20*a*(3) is that thread guide 30 (FIG. 8) has laid a new knitted stitch 32 in the hook 22*a*(4) of needle 20*a*(4).

Lastly, due to the action of cam 36*a* needle 20*a*(5) has returned to its lower, retracted position in groove 18*a*, which is the same as the waiting position. The descending movement of needle 20*a*(5) causes stitch M to slide towards the top of the needle. This sliding movement causes the latch 24*a*(5) to move into its closed position, bringing stitch M over the hook 22*a*(5) onto the knitting thread 32 that has just been laid in the hook. A new stitch M' is thus formed.

At the end of the needle's descent a mechanism (not shown) automatically sets the latch to the open position shown for needle 20*a*(1).

Figure 10:
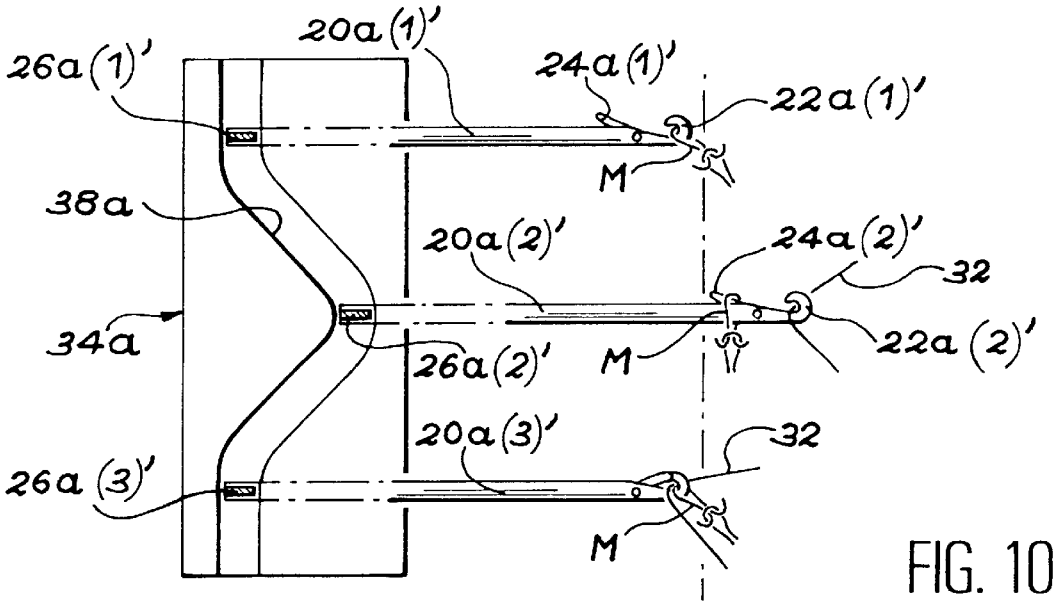
FIG. 10 is a top view showing a schematic representation of how a thread is engaged without forming a stitch on one of the courses of needles as the carriage of the machine passes.

FIG. 10 shows another cam 38*a* of cam system 34*a*. This cam 38*a* also consists of a groove housing the shanks 26*a* of the needles 26*a* located opposite carriage 28. This cam differs from cam 36*a* in that it causes the knitted thread to be engaged by the needles without forming a stitch. In order to make the process easier to understand the needles of FIG. 10 are numbered from top to bottom 20*a*(1)' to 20*a*(3)'.

The position of needle 20*a*(1)' is similar to that of needle 20*a*(1) in FIG. 9. In other words, this needle 20*a*(1)' is retracted into its groove, a stitch M is engaged by its hook 22*a*(1)' and its latch 24*a*(1)' is open.

Working from the top down, needle 20*a*(2)' of FIG. 10 is the central needle on which cam 38*a* acts. Its position in groove 18*a* is similar to that of needles 20*a*(2) and 20*a*(2) in FIG. 9, i.e. this needle 20*a*(2) is not in the extreme high position but rather in an intermediate position in which stitch M lies on the latch 24*a*(2)' without passing over its end. At this stage knitting thread 32 is lain in the hook 22*a*(2)' of this needle 20*a*(2)' by the thread guide 30 of carriage 28.

As the carriage continues its trajectory, the needle returns to its retracted position as was shown for needle 20*a*(3)' of FIG. 10. Under these conditions the stitch M falls back into the hook 22*a*(3)' in which lie both the said stitch M and knitting thread 32 that has just been lain there.

In order to manufacture the textile structure of the invention cam systems 34*a* and 34*b* may also adopt positions in which the passing of carriage 28 causes no displacement of the needles borne by the corresponding knitting heads 16*a* or 16*b*.

It will also be seen that shanks 26*a* and 26*b* of needles 20*a* and 20*b* are all identical when it is required that the carriage 28 commands all the needles without distinguishing between them.

In contrast, the shanks 26*a* and 26*b* of needles 20*a* and 20*b* of each course of needles may be of different lengths if it is required that the carriage 28 only commands movement of certain selected needles during some of its movements.

Under these circumstances cam systems 34*a* and 34*b* comprise a first series of cams whose position enables them to act only on needles with long shanks and a series of cams whose position enables them to act on all the needles.

The creation of a variety of textile structures according to the invention will now be described with reference to FIGS. 11 to 17. As described above, particular with reference to FIGS. 3 to 6, these different textile structures are distinguished from one another by their geometry. Each of FIGS. 11 to 17 is marked a to f to show the effect of successive passes of carriage 28 during a production cycle of the textile structure as described above with reference to FIG. 7. To make the process easier to understand the tips of hooks 22*a* and 22*b* of needles 20*a* and 20*b* are shown as dots in FIGS. 11 to 17. Moreover, only the knitting thread laid down during the last pass of the carriage is shown in each drawing.

Figure 11:
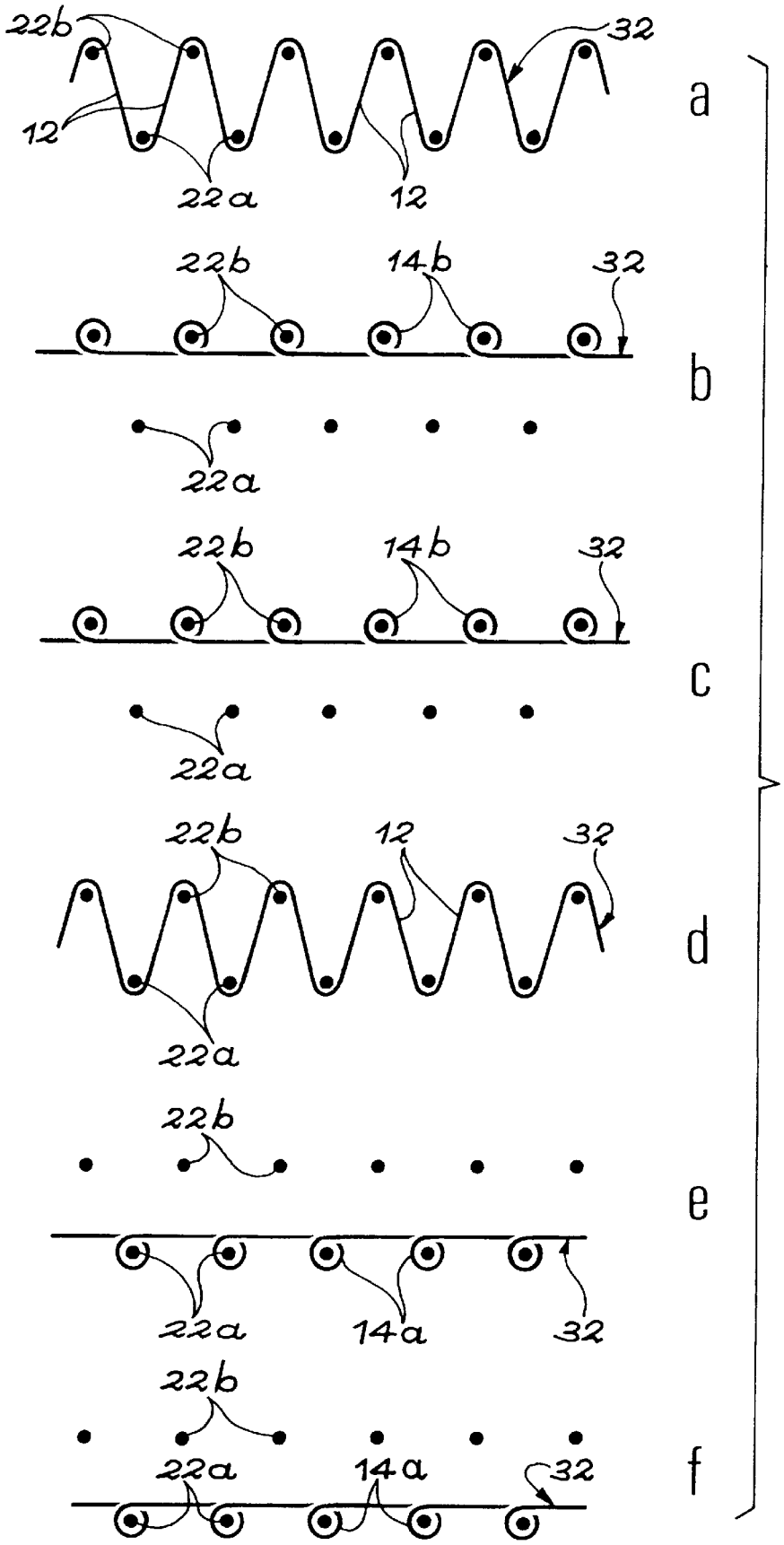
FIGS. 11 to 17 show from a to f the detailed steps comprising a production cycle of the textile structure of the invention for differently shaped textile structures.

FIG. 11 shows the manufacture of a textile structure with an architecture similar to that described above with reference to FIGS. 1 and 3. In this situation needles 20*a* and 20*b* are offset from one another in the direction of the weft of the textile structure being produced. This is obtained by offsetting knitting heads 16*a* and 16*b* from one another by half a unit perpendicularly to the plane of FIG. 8, as noted above.

a represents the first stage in the manufacturing cycle and consists in making a course of linking threads 12 as illustrated at a in FIG. 7. During this stage the passing of carriage 28 lays knitting thread 32 successively in the hooks 22*a* and 22*b* of two courses of needles so that the thread is engaged by all the needles of each course.

In the version of the invention shown at a in FIG. 11 the knitting thread 32 is laid in the hooks 22*a* and 22*b* of the needles without forming a loop. This result is obtained by setting a cam of the same type as cam 38*a* of FIG. 10 to the active position in each cam system 34*a* and 34*b*.

The passes of carriage 28 shown at b and c of FIG. 11 are those that are required to form two courses of stitches 14*b* on the layer 10*b* of the structure. These two passes of the carriage therefore constitute the second stage of the cycle, represented as b in FIG. 7. As has already been noted, the number of passes may be any number at least equal to 1, depending on the required magnitude of angle β.

Each time the carriage passes as shown at b and c in FIG. 11, the knitting thread 32 forms a course of stitches 14*b* on the hooks 22*b* of needles 20*b*. In contrast, no thread is lain in the hooks of needles 20*a*. To achieve this result a cam similar to cam 36*a* of FIG. 9 is selected in cam system 34*b* while cam system 34*a* is positioned so that the passing of carriage 28 has no effect on needles 20*a*.

The next passing of carriage 28, illustrated at d of FIG. 11 constitutes the third stage of the cycle, illustrated at c of FIG. 7. This pass has an identical effect to that illustrated at a of FIG. 11, i.e. the knitting thread 32 is again lain alternately in hooks 22*a* and 22*b* of needles 20*a* and 20*b* without forming a loop.

Given that no course of stitches has been formed on needles 20*a* since the passing of the carriage shown at a of FIG. 11, two courses of linking threads are engaged on hooks 22*a* of needles 20*a* after the passing of the carriage shown at d of FIG. 11. In contrast, the course of linking threads laid on hooks 22*b* of needles 20*b* during the passing of the carriage shown at a of FIG. 11 is separated from the course laid on the same hooks 22*b* during the passing of the carriage shown at d by the two courses of stitches created during the passes shown at b and c.

The passes of carriage 28 shown at e and f of FIG. 11 constitute the third stage of the cycle, illustrated at d in FIG. 7. These passes create two consecutive courses of stitches 14*a* of the layer 20*a* of the textile structure. In order to produce these courses of stitches cam systems 34*a* and 34*b* are given a symmetrical configuration compared with that they adopted during the passes shown at b and c of FIG. 11. More precisely, the cam system 34*b* is in a position such that carriage 28 has no effect on needles 20*b* as it passes. In contrast, cam 36*a* shown in FIG. 9 is selected from cam system 34*a*.

It will be understood that by repeating the cycle just described with reference to FIG. 11 a textile structure like that shown in FIG. 3 can be produced. In this structure the angle α is determined by the gap between the consecutive needles of each course of needles and angle β depends on the number of courses of stitches formed on each layer between passes of the carriage to form a course of linking threads.

Figure 12:
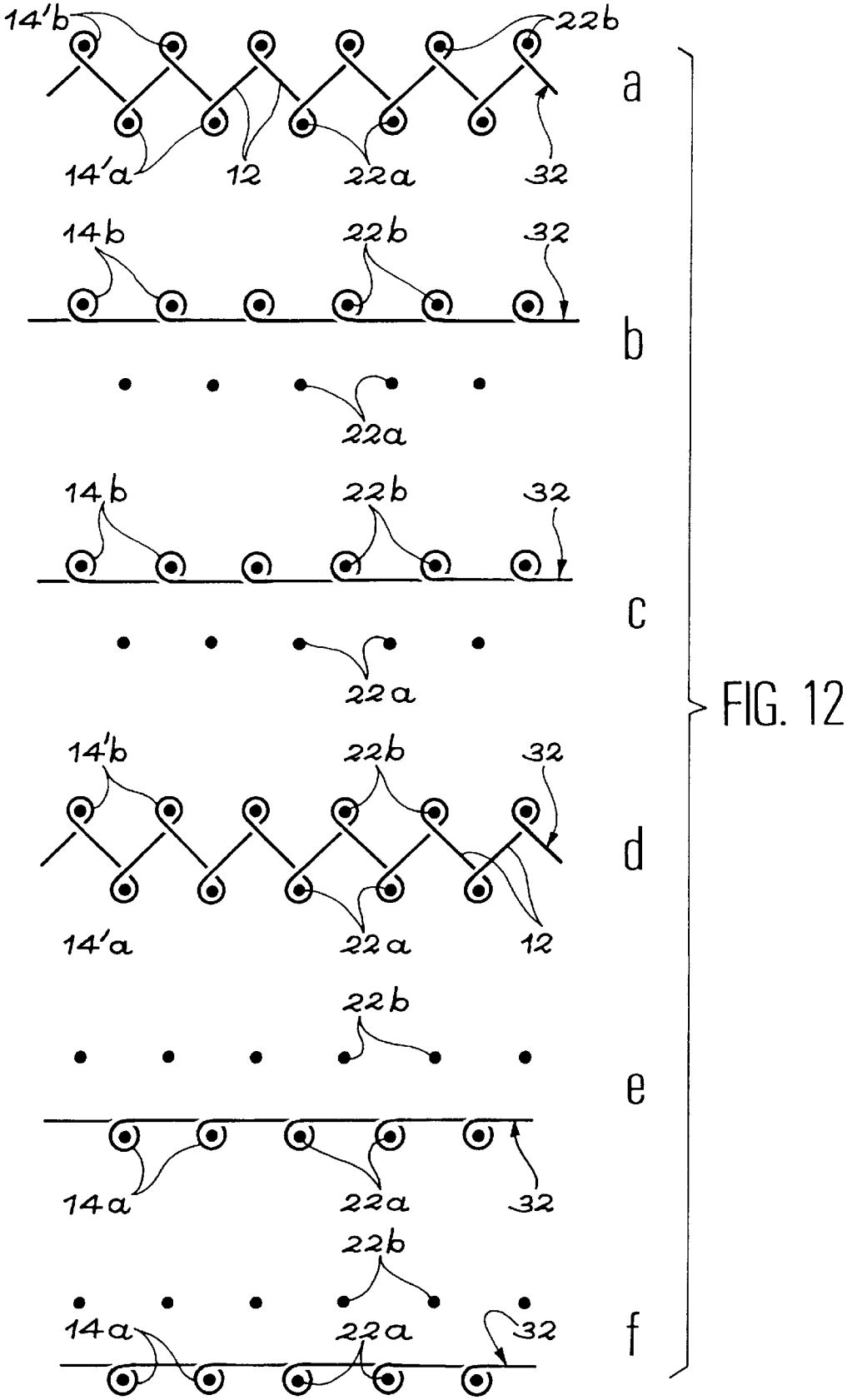

FIG. 12 shows a variant that only differs from the version described with reference to FIG. 11 in that each pass of carriage 28 produces courses of linking threads 12. These passes are shown at a and d of FIG. 12.

In this configuration instead of being engaged with the needles, i.e. with stitches 14*a*, 14*b* of corresponding courses of stitches in each of layers 10*a*, 10*b* without forming stitches, each course of linking threads 12 is engaged with each layer of the textile structure also forming stitches 14'*a*, 14'*b*. To achieve this result, before carriage 28 passes through the stages shown at a and d of FIG. 12, cams corresponding to cam 36*a* of FIG. 9 are selected on cam systems 34*a* and 34*b*.

Figure 13:
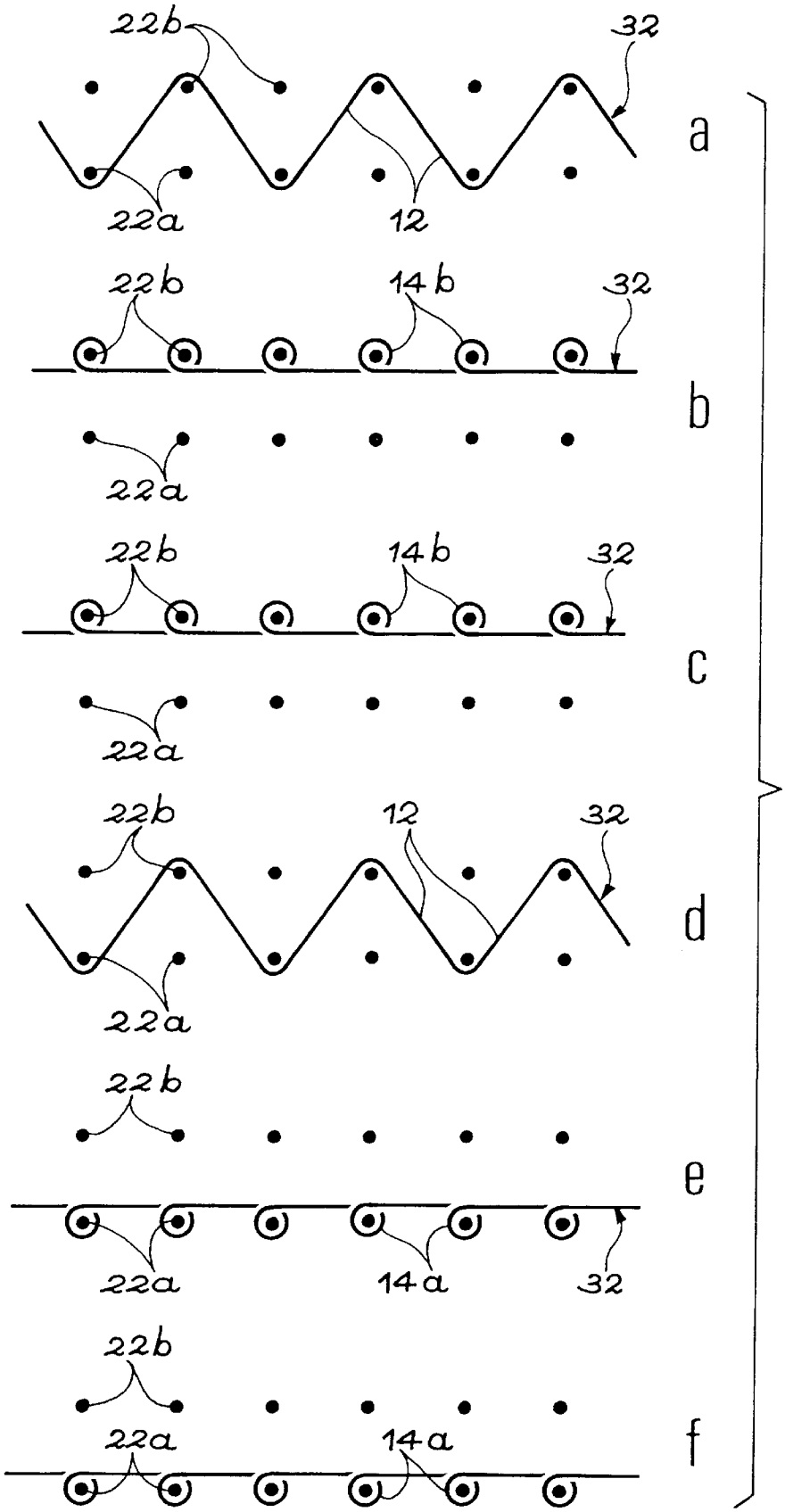

FIG. 13 shows different passes of carriage 28 when producing a textile structure of the type shown schematically in FIG. 4.

This version only differs from that described above with reference to FIG. 11 in the relative disposition of the two courses of needles 20*a*, 20*b* and in the two passes of carriage 28 to produce courses of linking threads 12.

For example, as shown in FIG. 13, instead of being offset from one another as in the versions of FIGS. 11 and 12, needles 20*a* and 20*b* of the two courses of needles are aligned, i.e. disposed opposite one another.

Moreover, when the carriage 28 passes to create courses of linking threads 12, shown at a and d of FIG. 13, the knitting thread 32, which is again laid alternately on needles 20*a* and 20*b* of the two courses of needles, is not laid on all the needles of each course.

More precisely, the version of the invention shown in FIG. 13 shows a situation in which thread 32 is engaged alternately with each every other needle in courses of needles 20*a* and 20*b*. Given that needles 20*a* and 20*b* are disposed facing one another, knitting thread 32 is only laid on one needle of each pair of needles 20*a* and 20*b* thereby formed. As has already been described with reference to FIG. 4, this disposition of courses of linking threads 12 gives the angle α formed by the threads in a weft direction of the textile structure a significantly higher value than when the linking threads are engaged with all the needles.

To implement the stages illustrated at a and d of FIG. 13, two different types of needles disposed alternately in each course of needles 20*a* and 20*b* are used so that each needle of one type lies between two needles of the other type. In addition, the needles 20*a* and 20*b* are mounted such that the needles located opposite one another are always of different types. As described above, the essential difference between the two types of needles lies in the length of their shanks.

In this situation, in order to perform the passes shown at a and d of FIG. 13, the cam systems 34*a* and 34*b* of carriage 28 are set to select cams similar to cam 38*a* of FIG. 10. The position of this cam is such that it only actuates needles 20*a* and 20*b* with long shanks (i.e. on every other needle in each course of needles).

Moreover, in order to perform the passes shown at b and c, two cams similar to cam 36*a* of FIG. 9 are selected from cam system 34*b*. The locations of these cams enable them to act simultaneously on all the needles 22*b* irrespective of type.

Similarly, before carriage 28 passes through the stages shown at e and f of FIG. 13, cams corresponding to cam 36*a* of FIG. 9 are selected on cam system 34*a* so that they actuate simultaneously all the needles 22*a*.

In all the versions of the invention described thus far with successive reference to FIGS. 11 to 13, each pass of carriage 28 to create a course of linking threads 12 causes thread 32 to be engaged with the same needles 20*a* and 20*b* in each course of needles. All the linking threads 32 are thus aligned when the textile structure is observed in the direction of the warp.

Figure 14:
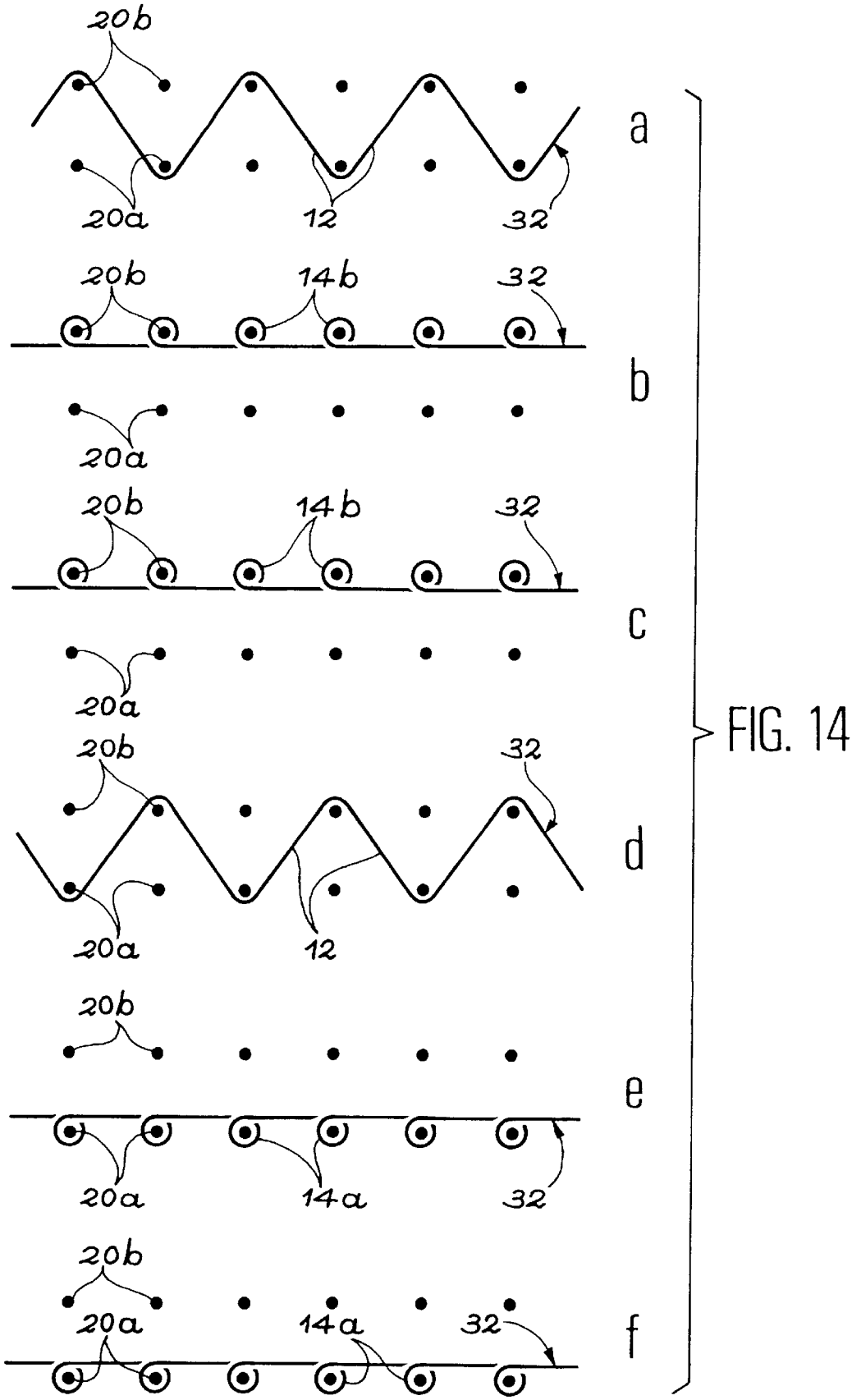

In contrast, in the version shown in FIG. 14, the passes of 28 shown at a and d, which represent the creation of two consecutive courses of linking threads 12, the knitting thread 32 is engaged with different needles in each of two courses of needles 20*a* and 20*b*.

More precisely, needles 20*a* and 20*b* of the two courses of needles are positioned facing one another as in the version shown in FIG. 13. Moreover, the first pass of the carriage shown at a of FIG. 14 has the effect of engaging the knitting thread 32 alternately with a needle of course 20*a* and a needle of course 20*b*, leaving an empty needle in each of the two courses of needles. In contrast, the pass of the carriage shown at d of FIG. 14 has the effect of laying knitting thread 32 alternately in the needles of each of the two courses of needles 20*a* and 20*b* left free during the pass of the carriage shown at a in the same figure.

To achieve this result, two different types of needles are used in each course of needles 20*a* and 20*b*, as in the version shown in FIG. 13. These needles are disposed so that each needle of one type lies between two needles of the other type in each course and needles placed facing one another are of different types.

For example, a cam similar to cam 38*a* of FIG. 10 actuates needles 20*a* and 20*b* of a given type without actuating the needles of the other type during the pass shown at a in FIG. 14. In contrast, during the pass shown at d in FIG. 14 another cam similar to cam 38*a* of FIG. 10 is selected on each of cam systems 34*a* and 34*b* so that it only actuates the needles of the other type when carriage 28 passes.

In this version of FIG. 14 during the passes of carriage 28 shown at b, c, and e, f, one or other of cam systems 34*a* and 34*b* is fitted at the same time with two cams similar to cam 36*a* of FIG. 9 so that they actuate simultaneously the two series of needles of the courses of needles required to produce courses of stitches 14*a* and 14*b*.

Figure 15:
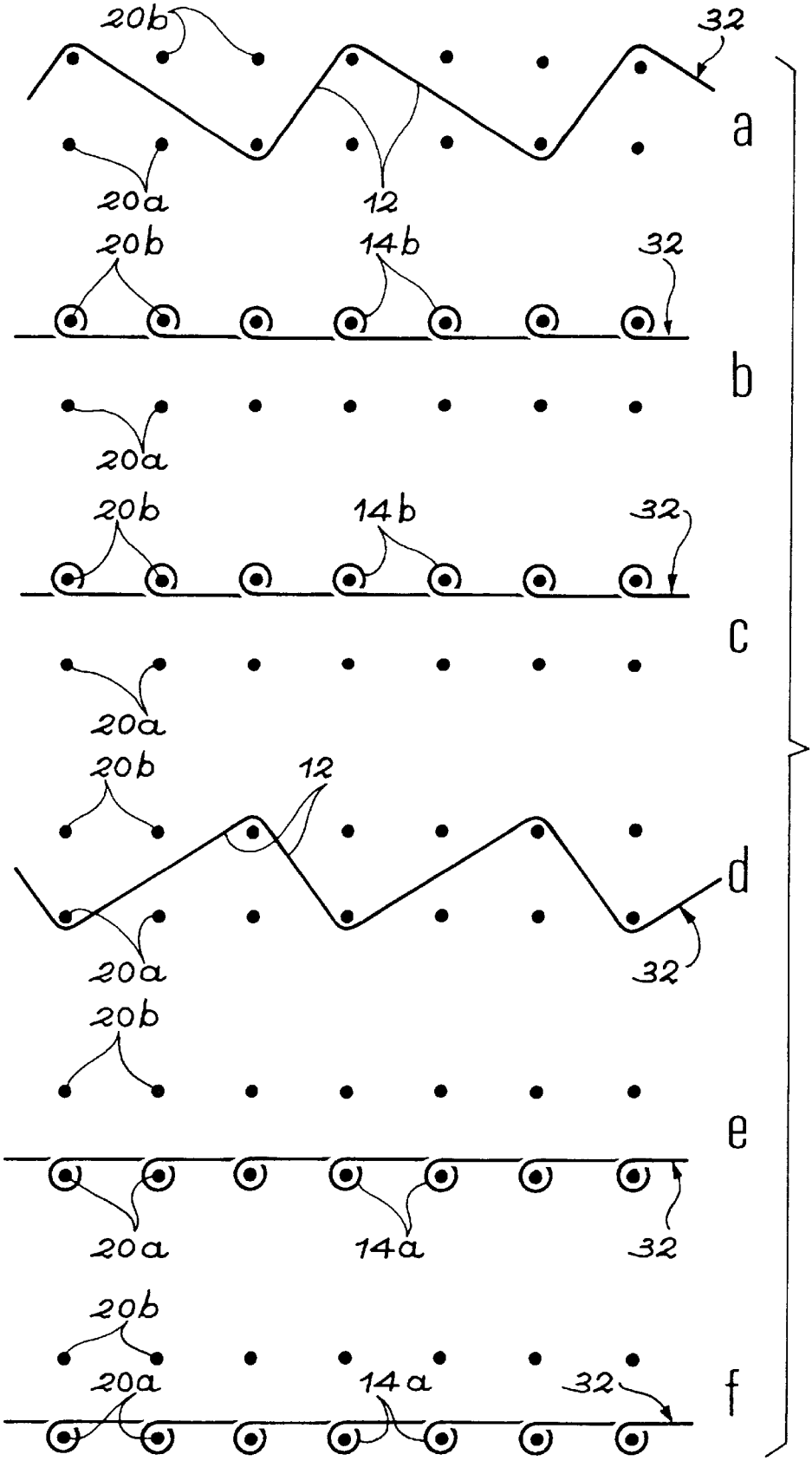

FIG. 15 gives concrete examples of the various stages of producing a textile structure such as that described above with reference to FIG. 6. This version can only be distinguished from the preceding version by the passes of carriage 28 shown at a and d of this figure, which shows the creation of courses of linking threads 12. As before, the needles of the two courses of needles 20*a* and 20*b* are disposed facing one another.

During the pass of carriage 28 shown at a in FIG. 15, the thread guide 30 lays thread 32 alternately on needle 20*a* and needle 20*b*, omitting two needles unfilled in each course of needles.

During the pass of the carriage shown at d in FIG. 15, during which the next course of linking threads 12 is laid, the thread guide 30 lays the thread 32 alternately on selected different needles 20*a* and 20*b* of each course of needles. These needles are selected to be facing those on which the thread 32 was laid during the pass of the carriage shown at a in FIG. 15 to create the previous course of linking threads 12.

It will easily be understood that the use of two different types of needles, together with correct selection of cams, will give the results shown in FIG. 15.

As has already been described with reference to FIG. 6, the textile structure obtained in this situation is characterized by the fact that the linking threads 12 are disposed crosswise when the textile structure is observed in the direction of the warp and by the fact that these linking threads are oriented in two different angles of incidence relative to layers 10*a* and 10*b* of the structure.

Figure 16:
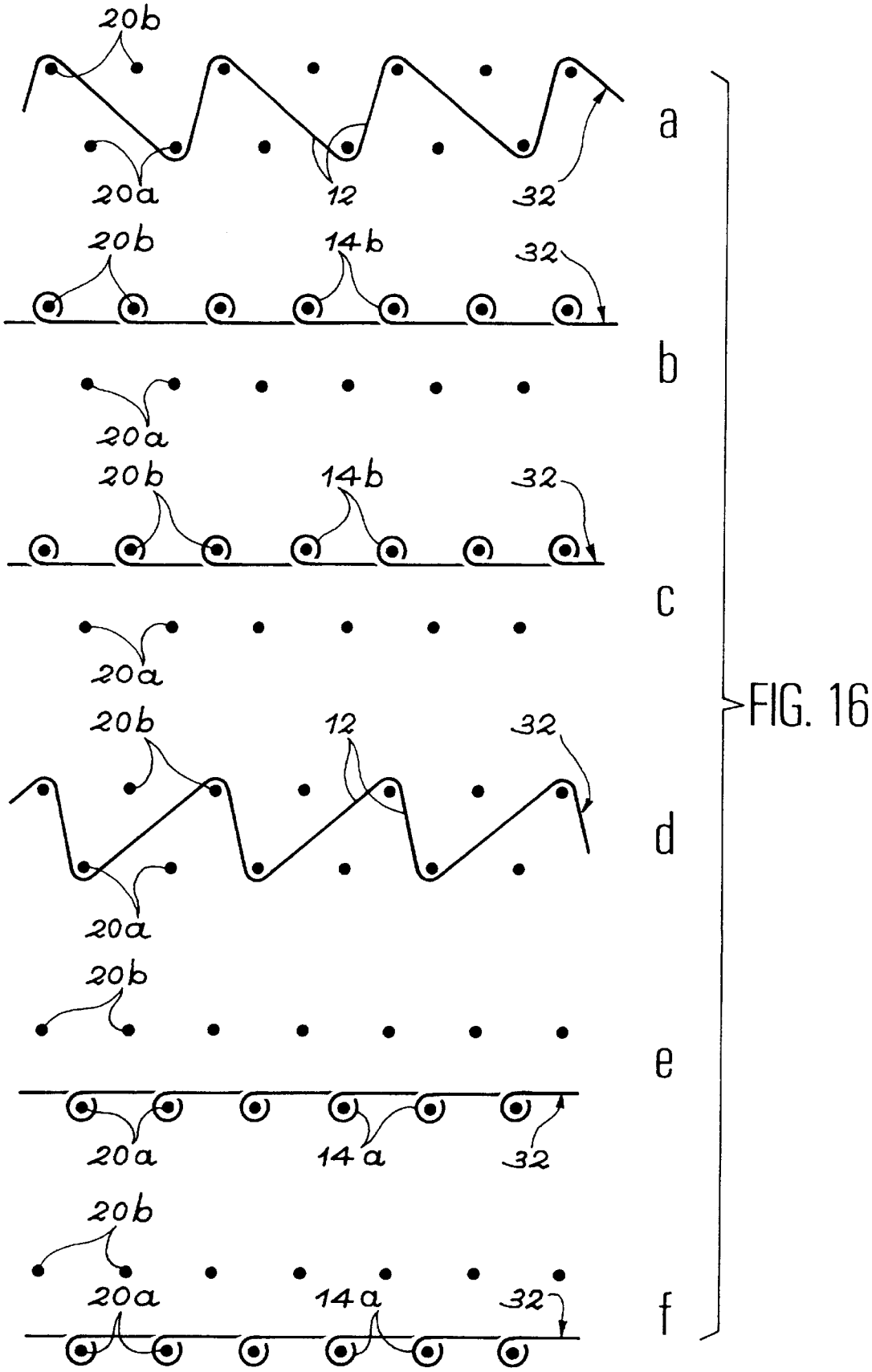

FIG. 16 shows how a structure comparable to that of FIG. 6 may be obtained with angles $\alpha$ of a lower value than in the version shown in FIG. 15.

In this situation, the needles of the two courses of needles 20*a* and 20*b* are no longer disposed facing one another but offset as in the version described above with reference to FIG. 11. Moreover, laying two consecutive courses of linking threads 12 as shown at a and d of FIG. 16, is performed on the same needles in one of the courses of needles (course 20*b* in the figure) and on different needles in the other course of needles (20*a*).

More precisely, during the pass of carriage 28 shown at a in FIG. 16, the thread guide 30 lays thread 32 alternately on needle 20*a* and needle 20*b*, omitting two needles unfilled in each course of needles.

During the pass of carriage 28 shown at d in FIG. 16, during which the next course of linking threads 12 is laid, the thread guide 30 lays the thread 32 on the same needles 20*b* as during the pass shown at a and on the needles 20*a* left empty during the pass shown at a.

This result is once again achieved by using two different types of needles and the same type of cam as cam 38*a* of FIG. 10 in system 34*b* during the passes shown at a and d of FIG. 16 so that the same series of needles is actuated on course of needles 20*b*. In contrast, a different cam similar to cam 38*a* is used in cam system 34*a* for the passes shown at a and d of FIG. 16 so that different needles 20*a* are actuated during these two passes.

Figure 17:
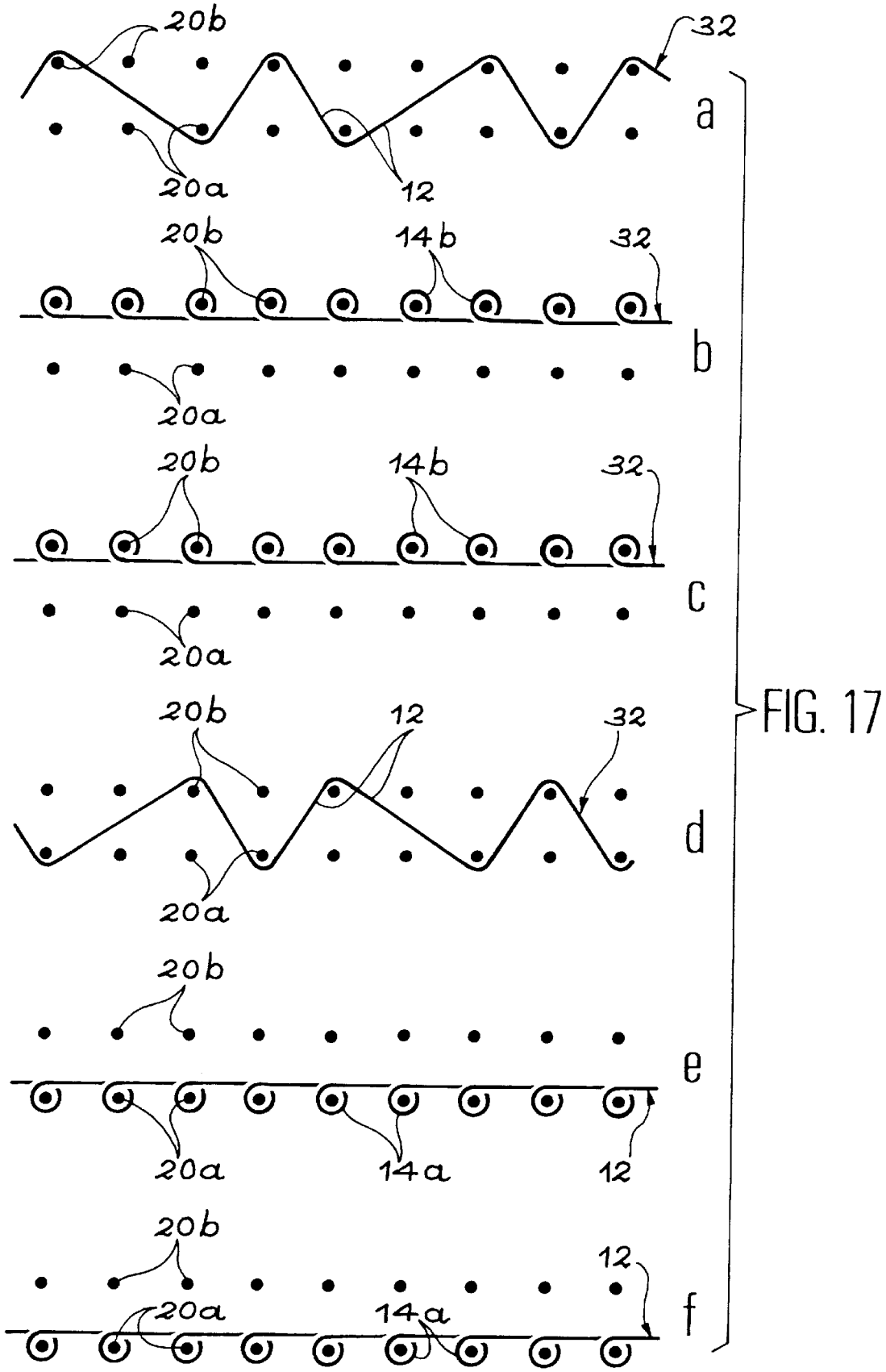

FIG. 17 shows how to obtain a geometry of the linking threads 12 of the textile structure that has not yet been described. This geometry is mainly distinguished from those already described by the fact that the engagement points of the linking threads on layers 10*a* and 10*b* are separated by distances that vary periodically between two different values.

In this version the needles of the two courses of needles 20*a* and 20*b* are again disposed facing one another.

During the pass of carriage 28 shown at a of FIG. 17 the thread guide 30 lays the thread 32 alternately on a needle 20*a* and a needle 20*b* of each of the two courses of needles leaving two needles empty two passes running, followed by one needle free on each of the two courses. More precisely, the knitting thread 32 is routed so that it is engaged with one needle from one of the two courses of needles on either side of which lie the two free needles of the course and opposite which is located a single free needle of the other course of needles.

During the pass of carriage 28 shown at d of FIG. 17, thread 32 is engaged with needles 20*a* and 20*b* symmetrically compared with that described above for the pass shown at a of the figure, taking as reference the vertical plane of symmetry of knitting heads 16*a* and 16*b* on either side of which the two courses of needles lie.

It will be readily understood that the use of two different types of needle in each of the two courses of needles, together with different types of cams, enables the operations shown in FIG. 17 to be achieved.

In all the versions described above with reference to FIGS. 13 to 17 the courses of linking threads 12 are engaged with each of the two layers 10*a*, 10*b* without forming a stitch using cams similar to cam 38*a* of FIG. 10. As described with reference to FIG. 12 concerning the version of the invention shown in FIG. 11, each version of FIGS. 13 to 17 has a variant in which the engagement of linking threads 12 with each of the layers 20*a* and 20*b* is effected by forming stitches using cams similar to cam 36*a* of FIG. 9.

Figure 18:
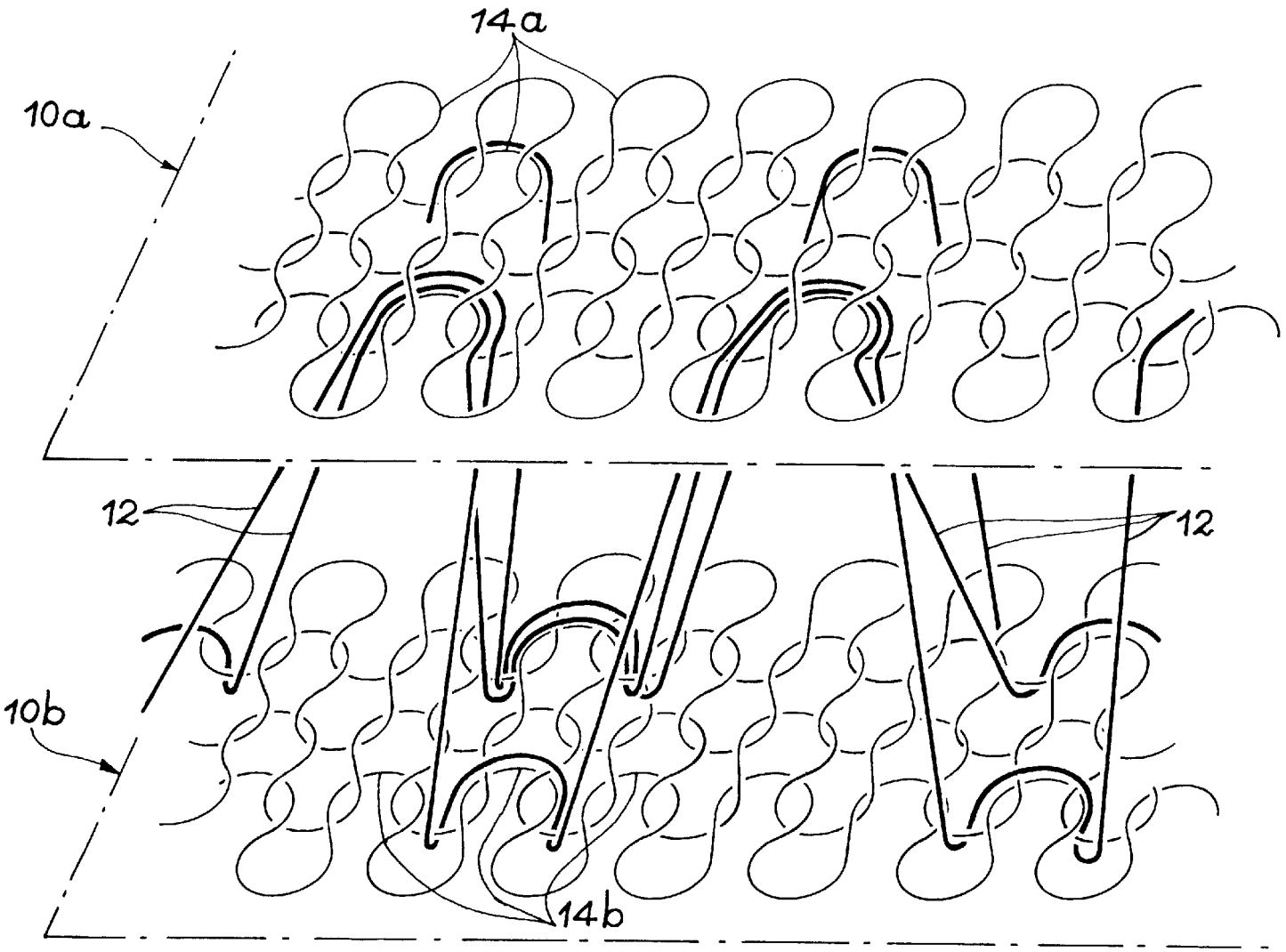
FIG. 18 is a perspective view showing a section of the textile structure obtained by the production cycle illustrated in FIG. 11.

To make for easier understanding of the invention, FIG. 18 shows a perspective view of part of a textile structure obtained using the operations described above with reference to FIG. 11. This textile structure also corresponds to that previously described schematically with reference to FIGS. 1 and 3.

In order for angle β to have the desired value the two layers of the textile structure of the invention are constructed in turn after completion of a course of linking threads. This gives the construction of the structure an asymmetrical structure which may lead to replacing the traction stress usually exerted continuously on the structure with stress whose direction is variable. For example, the knitting machine may be fitted with a traction system that applies stress to the textile structure in a direction opposite to the layer being constructed, relative to the vertical plane of symmetry of the knitting heads.

As has already been pointed out, the textile structure of the invention may be composed of a single knitting thread 32 or many threads, thereby making it possible to construct the two layers 10*a* and 10*b* as well as the linking threads 12 of different materials. The knitted threads may be composed of different materials such as glass, kevlar®, carbon, silicon carbide, etc.

The textile structure obtained is very flexible, which makes it possible to shape it with single or multiple curvature depending on the application required.

As has been shown, the original design of the textile structure of the invention makes it possible to control the orientation of the linking threads 12, both in the weft and warp directions of the structure. This characteristic gives the textile structure the ability to be adapted to any type of mechanical properties required; this was not hitherto possible.

It should be noted that the textile structure obtained from the knitting machine may be used in its untreated state or associated with a matrix to constitute a composite material.

When the textile structure is used in its dry state, i.e. without being impregnated, it may particularly be used for the construction of fireproof clothing or barriers. The use of suitable threads can give the textile structure excellent heat insulating properties. These properties are due partly to the threads used, which may in particular be made of highly-divided microfibers, and partly to the volume swell and inflatable character of these textile structures. These last two characteristics are also valuable in the manufacture of anti-shrapnel textiles for use in the creation of clothing designed to protect against this type of hazard.

In order to improve the heat insulation properties of the textile structure without reducing its flexibility, one surface of the structure could be coated with a flexible elastomer-based microporous layer that would enable gaseous exchange through the textile to be controlled.

When the textile structure of the invention is used as a reinforcement in a composite material it may be used either for producing a material that can be used at moderate temperature (less than 400° C.) in the case of an organically impregnated matrix or for producing a refractory composite material using a ceramic or carbon impregnation matrix.

In the context of the production of a composite material that can be used at moderate temperature, the uniform nature of the textile structure of the invention, constructed as it is in a single knitting operation, makes it suitable for manufacturing flat sandwich panels with an greater overall cohesion than that of panels assembled by bonding. The mechanical resistance of this type of panel is conferred by the imbrication of the two networks of threads (the linking threads of the core and the strengthening threads of the layers). A non-limitative example of this type of application might be a flat sandwich panel made of glass fiber in an epoxy resin matrix.

To make the fullest possible use of the advantages of the textile structure of the invention a shapeable sandwich structure could be shaped on any type of curved block. The textile structure made, for example, of carbon thread, may be applied to a block such as a truncated cylinder or cone by, for example, back pressure applied by means of an inflatable bladder. In order to keep the two layers apart, polytetrafluoroethylene strips may be inserted between the linking threads. The space between the layers may also be kept under pressure or use may be made of vacuums as described in documents EP-A-0 449 033 and WO-A-92 21541. The assembly composed of the textile structure and shaping equipment is then immersed in diluted epoxy resin to coat the fibers with the quantity of resin necessary to make a composite material. The resin is then polymerized to give the required shape.

It should be noted that the mesh structure of the layers of the textile structure of the invention makes it possible for a fluid such as a gas, liquid or powder to be introduced into the structure where it may be fixed or allowed to flow.

As a non-limitative example, a textile structure of the invention made of glass fiber is impregnated with polyester resin as described above before being polymerized. The textile structure is then rigid but permeable due to the fact that the glass fibers have been impregnated with polyester. A filler matrix composed, for example, of carbon black is then introduced into the space left empty between the linking threads. Complete filling of this space can be facilitated by ultrasound vibration. The filler matrix may be trapped in situ either using a suitable formula or by sealing the layers by means of waterproof layers bonded onto the external layers of the sandwich. The structure thereby obtained has the advantage of having excellent resistance to high temperatures.

Because, unlike standard honeycomb-type sandwich structures the space inside the textile structure of the invention is not partitioned, it is possible for a fluid to penetrate inside the structure parallel to the layers. For example, a coolant fluid may circulated inside a resin-impregnated textile structure according to the invention, thereby cooking a structure in contact with one of the layers made of a heat-conducting thread such as carbon thread.

This application demonstrates that the type of threads selected to form the layers of the textile structure of the invention may be adapted according to the application required, particularly where it is necessary to make the best of properties of thermal conduction (carbon thread) or thermal insulation (silica or glass thread).

Another example of the use of a textile structure according to the invention relates to the creation of inflatable structures. In this application the textile structure is produced using flexible threads (kevlar®, polyethylene, etc.) These threads are impregnated with an elastomer impregnation matrix at the low point of vitreous transition (butyl rubber, isobutyl, polychloroprene, etc.) the use of such materials makes it possible to fix in advance by means of the textile structure the shape of the structure developed by inflating while reducing its size in the deflated state. This significantly reduces weight by eliminating the usual structural parts such as metal struts as well as reducing dimensions.

When the textile structure of the invention is integrated in a composite material it may advantageously be applied to the manufacture of anti-ballistic shielding due the possibility of altering its thickness and screen shape at will. The combination of the textile structure with standard thermal screens disposed as external layers makes it possible to optimize the design of this type of shielding from the point of view of the weight/efficiency ratio in order to make the best use of the destabilizing effect of the external layer.

As has already been pointed out, the textile structure of the invention may also be used in the manufacture of refractory composite materials. In this situation the threads used, like the matrix, are of the ceramic or carbon material type.

A first example of this particular field of application relates to carbon-carbon composite materials obtained using a textile structure according to the invention, constructed using carbon fibers that are subsequently impregnated with diluted phenol resin and subjected to pyrolysis in an argon atmosphere. The resulting carbon—carbon composite has an apparent density in the region of 0.08 g/cm$^3$ which may be increased up to 0.20 g/cm$^3$ by chemical deposition in vapor phase. The resistance to compression at 20° C. of this type of material is 2 MPa for a density of 0.08 g/cm$^3$. These properties make it possible to envisage using these types of materials in the manufacture of support structures for optical structures to be used in the sector of space exploration.

On the same principle silica—silica composite materials can also be produced using textile structure according to the invention. These materials have radioelectrical characteristics that are exceptional from the point of view of transparency. This is due to the nature of the materials (silica) and the very porous architecture (porosity 90–95%) while retaining the mechanical characteristics associated with the sandwich core. This type of material is suitable for use in all applications in which good radioelectrical transparency is required, as is particularly the case for refractory radomes for high-resolution radar systems.

Lastly, the textile structure of the invention may also be used in the manufacture of ceramic—ceramic composite materials constructed using glass or ceramic fibers and an impregnation matrix of these fibers in liquid or gaseous form capable of resisting high temperatures.

What is claimed is:

1. Textile structure formed from at least one knitted thread and comprising two layers each of which consists of courses of stitches and a core composed of courses of linking threads connecting the two layers, each course of linking threads being attached on one or the other of the layers alternately to a different stitch of a single course of stitches to form a first non-zero angle ($\alpha$) between consecutive linking threads of the same course of linking threads, characterized by the fact that two consecutive courses of linking threads are attached to a single course of stitches of one of the layers and to non-consecutive courses of stitches of the other layer to form a second, non-zero angle ($\beta$) between consecutive courses of linking threads, the first angle ($\alpha$) and the second angle ($\beta$) being measured in planes that both form angles other than 90° with the planes of the layers.

2. Textile structure of claim 1 characterized in that the courses of linking threads are engaged with the courses of stitches without forming stitches.

3. Textile structure of claim 1 characterized in that the courses of linking threads are engaged with the courses of stitches thereby forming stitches.

4. Textile structure of claim 1 characterized in that all the courses of linking threads are engaged with courses of stitches aligned in a warp direction of the textile structure.

5. Textile structure of claim 1 characterized in that the consecutive courses of linking threads are engaged with courses of stitches that are offset in one direction of the warp of the textile structure and by engaging alternate courses of linking threads to stitches aligned with the direction of the warp of the textile structure.

6. Textile structure of claim 1 characterized in that each course of linking threads is engaged alternately on each layer with all consecutive stitches of a single course of stitches.

7. Textile structure of claim 1 characterized in that each course of linking threads is engaged alternately on each layer with non-consecutive stitches of the same course of stitches separated by a constant number of stitches that is at least 1.

8. Textile structure of claim 1 characterized in that each course of linking threads is engaged alternately on each layer with non-consecutive stitches of the same course of stitches separated by a number of stitches that varies between two different values to give a regular pattern.

9. Textile structure of claim 1 characterized in that the courses of stitches of the two layers are disposed facing one another.

10. Textile structure of claim 1 characterized in that the stitches of the two layers are offset so that each stitch of one layer is located between two stitches in the other layer working in the direction of the weft of the structure.

11. Textile structure of claim 1 characterized by also including a matrix impregnating and shaping the knitted thread, the core of the structure forming an open space between the linking threads.

12. Textile structure of claim 11 characterized in that the matrix fills at least in part the open space.

13. A method for manufacturing a textile structure formed from at least one knitted thread and comprising two layers each of which is composed of courses of stitches and a core composed of courses of linking threads connecting the two layers, characterized by repeating the following steps, in sequence:

constructing a first course of linking threads by engaging knitted thread alternately on different needles of first and second courses of facing needles;

constructing at least one course of stitches on a first course of needles;

constructing a second course of linking threads by engaging knitted thread with first and second course of needles alternatively;

constructing at least one course of stitches on the second course of needles.

14. Method of claim 13 characterized in that first and second courses of linking threads are formed by engaging the knitted thread with the needles without forming stitches.

15. Method of claim 13 characterized in that first and second courses of linking threads are formed by engaging the knitted thread with the needles so as to form stitches.

16. Method of claim 13 characterized in that first and second courses of linking threads are formed by engaging the knitted thread with the same needles on the first and second courses of needles.

17. Method of claim 13 characterized in that first and second courses of linking threads are formed by engaging the knitted thread with different needles on at least the first and second courses of needles.

18. Method of claim 13 characterized in that first and second courses of linking threads are formed by engaging the knitted thread with consecutive needles of the first and second courses of needles, the two courses of needles being offset from one another in the direction of the weft of the structure being produced.

19. Method of claim 13 characterized in that first and second courses of linking threads are formed by engaging the knitted thread with non-consecutive needles of the first and second courses of needles, separated by a constant number of needles.

20. Method of claim 19 characterized in that first and second courses of linking threads are formed by engaging the knitted thread with non-consecutive needles of the first and second courses of needles, the two courses of needles being separated by a number of stitches that varies between two different values.

21. Method of claim 19 characterized in that the two courses of needles are offset from one another in the direction of the weft of the structure being produced.

22. Method of claim 19 characterized in that the two courses of needles are disposed facing one another.

23. Method of claim 19 characterized by shaping the formed textile structure by placing the structure on a shaping surface and impregnating the knitted thread with an impregnation material while keeping the two layers of the structure apart from one another, and then hardening the impregnation material so that the core of the structure forms an open space free of impregnation material between the linking threads.

24. Method of claim 23 characterized by filling the open space with a filler material.

* * * * *